US011049679B2

(12) United States Patent
Lu et al.

(10) Patent No.: US 11,049,679 B2
(45) Date of Patent: Jun. 29, 2021

(54) CONTACTOR

(71) Applicant: ZHEJIANG CHINT ELECTRICS CO., LTD., Zhejiang (CN)

(72) Inventors: Jing Lu, Zhejiang (CN); Qianjun Zheng, Zhejiang (CN); Ping Xu, Zhejiang (CN); Zhiwen Zhang, Zhejiang (CN); Tifeng Xiao, Zhejiang (CN)

(73) Assignee: ZHEJIANG CHINT ELECTRICS CO., LTD., Zhejiang (CN)

( * ) Notice: Subject to any disclaimer, the term of this patent is extended or adjusted under 35 U.S.C. 154(b) by 315 days.

(21) Appl. No.: 16/309,156

(22) PCT Filed: Oct. 24, 2016

(86) PCT No.: PCT/CN2016/103110
§ 371 (c)(1),
(2) Date: Dec. 12, 2018

(87) PCT Pub. No.: WO2018/006511
PCT Pub. Date: Jan. 11, 2018

(65) Prior Publication Data

US 2019/0228937 A1 Jul. 25, 2019

(30) Foreign Application Priority Data

Jul. 8, 2016 (CN) ..... 201610537744.6

(51) Int. Cl.
*H01H 50/14* (2006.01)
*H01H 50/02* (2006.01)
(Continued)

(52) U.S. Cl.
CPC ..... *H01H 50/14* (2013.01); *H01H 45/02* (2013.01); *H01H 50/02* (2013.01); *H01H 50/18* (2013.01);
(Continued)

(58) Field of Classification Search
CPC ..... H01H 50/02; H01H 50/14; H01H 50/18; H01H 50/443; H01H 50/541; H01H 45/02; H01H 50/60
See application file for complete search history.

(56) References Cited

U.S. PATENT DOCUMENTS 6,285,271 B1 * 9/2001 Bauer ..... H01H 50/543 335/132
7,936,241 B2 * 5/2011 Drexler ..... H01H 71/08 335/202
(Continued)

FOREIGN PATENT DOCUMENTS

CN 2857207 Y 1/2007
CN 201041789 Y 3/2008
(Continued)

OTHER PUBLICATIONS

International Search Report dated Mar. 30, 2017 in corresponding PCT International Application No. PCT/CN2016/103110.
(Continued)

*Primary Examiner* — Bernard Rojas
(74) *Attorney, Agent, or Firm* — Ostrolenk Faber LLP

(57) ABSTRACT

A contactor including a pedestal. The pedestal is of a step structure having notches in two ends. The step structure includes a first step and a second step from bottom to top and is covered with a cover body having a matched shape. A part, which protrudes out of the second step, at each of two ends of the first step, is provided with a first mounting groove in which a control terminal and a power terminal that are spaced apart from each other are mounted, and the cover body is provided with a first wiring port corresponding to the control terminal and a second wiring port corresponding to the power terminal. Each of two ends of the second step is provided with a second mounting groove in which an auxiliary terminal is mounted, and the cover body is pro-
(Continued)

vided with a third wiring port which corresponds to the auxiliary terminal mounted in the second mounting groove. The contactor has a simple structure, and wiring areas can be distinguished.

9 Claims, 6 Drawing Sheets

(51) Int. Cl.

| | |
|---|---|
| ***H01H 50/18*** | (2006.01) |
| ***H01H 50/44*** | (2006.01) |
| ***H01H 50/54*** | (2006.01) |
| ***H01H 50/60*** | (2006.01) |
| ***H01H 50/62*** | (2006.01) |
| ***H01H 45/02*** | (2006.01) |

(52) U.S. Cl.
CPC ..... *H01H 50/443* (2013.01); *H01H 50/541* (2013.01); *H01H 50/60* (2013.01)

(56) References Cited

U.S. PATENT DOCUMENTS 8,305,170 B2 * 11/2012 Koppmann ..... H01H 50/541 335/202
2008/0106362 A1 * 5/2008 Portier ..... H01H 50/443 335/132
2015/0248983 A1 * 9/2015 De Barros Albuquerque ..... H01H 50/18 335/133

FOREIGN PATENT DOCUMENTS

| | | | |
|---|---|---|---|
| CN | 101174522 | A | 5/2008 |
| CN | 201087896 | Y | 7/2008 |
| CN | 104520960 | A | 4/2015 |
| CN | 104538256 | A | 4/2015 |
| CN | 205828281 | U | 12/2016 |
| DE | 69201996 | T2 | 10/1995 |
| WO | WO 2008/031699 | A1 | 3/2008 |

OTHER PUBLICATIONS

Written Opinion dated Mar. 30, 2017 in corresponding PCT International Application No. PCT/CN2016/103110.

* cited by examiner

CONTACTOR

CROSS-REFERENCE TO RELATED APPLICATIONS

The present application is a 35 U.S.C. §§ 371 national phase conversion of PCT/CN2016/103110, filed Oct. 24, 2016, which claims priority to Chinese Patent Application No. 201610537744.6, filed Jul. 8, 2016, the contents of which are incorporated herein by reference. The PCT International Application was published in the Chinese language.

TECHNICAL FIELD

The present invention relates to the field of low-voltage apparatuses, and in particular, to a contactor.

BACKGROUND ART

In the prior art, auxiliary terminals and control terminals of most contactors tend to be in the same plane, and a large number of wires to be connected often cause a user to confuse the distribution relationship between single wires and the corresponding connection terminals in the contactors. In addition, due to various reasons (a control circuit diagram is improved, a control wire is damaged, etc.), the user needs to disassemble or assemble a control circuit when a main circuit is connected. Since the existing control circuit is generally located below the main circuit and is affected by a wire of the main circuit, it is inconvenient for the user to directly disassemble or assemble the control circuit, disassemble the wire of the main circuit, and then disassemble or assemble the control circuit. In addition, if the user needs more auxiliary contacts for logic control, then accessories need to be purchased for expansion installation on the contactor. However, there is a risk of poor matching between the accessories and the contactor (the installation is not in place, the structure is incorrect, etc.), which affects the on-off reliability of the auxiliary contacts of an accessory module.

SUMMARY OF THE INVENTION

An objective of the present invention is to overcome the defects of the prior art and provide a contactor which has a simple structure, and wiring areas can be distinguished apparently.

To fulfill the said objective, the present invention adopts the following technical solution.

A contactor comprises a pedestal 2, wherein the pedestal 2 is of a step structure having notches in two ends; the step structure comprises a first step 201 and a second step 202 from bottom to top and is covered with a cover body 3 having a matched shape; a part, which protrudes out of the second step 202, at each of two ends of the first step 201 is provided with a first mounting groove in which a control terminal 21 and a power terminal 22 that are spaced apart from each other are mounted, and the cover body 3 is provided with a first wiring port 31 corresponding to the control terminal 21 and a second wiring port 32 corresponding to the power terminal 22; each of two ends of the second step 202 is provided with a second mounting groove in which an auxiliary terminal 23 is mounted, and the cover body 3 is provided with a third wiring port 33 which corresponds to the auxiliary terminal 23 mounted in the second mounting groove.

Preferably, the first wiring port 31 and the second wiring port 32 are formed in the corresponding cover body 3 in a direction perpendicular to the top surface of the first step 201; the third wiring port 33 is formed in the cover body 3 in a direction perpendicular to the top surface of the second step 202.

Preferably, the control terminal 21 and the power terminal 22 are not aligned, such that the control terminals 21 located at two ends of the first step 201 are closer to or away from the middle part of the first step 201 relative to the respective power terminals 22 located on the same end; the first wiring port 31 corresponding to the control terminal 21 is also not aligned to the second wiring port 32 corresponding to the power terminal 22.

Preferably, an assembling groove is formed in the middle of the first step 201; a contact support 24 is mounted in the assembling groove; the contact support 24 protrudes out of the top surface of the first step 201; the second step 202 is of an assembled structure and comprises a first assembling block 204 and a second assembling block 205 which can be assembled, wherein the first assembling block 204 and the second assembling block 205 are mounted on the first step 201 and are located on two sides of the contact support 24 and clamped with the contact support 24 respectively.

Preferably, a surface, which is in contact with the contact support 24, of each of the first assembling block 204 and the second assembling block 205 is provided with a vertical limiting rib 202*a*; a limiting groove 24*a* which is matched with the limiting rib 202*a* is formed in two sides of the contact support 24 respectively.

Preferably, the middle part of the first step 201 extends towards the first assembling block 204 and the second assembling block 205 respectively to form positioning ribs 201*a* located on two sides of the contact support 24; each of the first assembling block 204 and the second assembling block 205 is provided with a positioning groove 202*b* which is matched with the corresponding positioning rib 201*a*; during the mounting process, the first assembling block 204 and the second assembling block 205 are pushed towards the contact support 24 along the positioning ribs 201*a* respectively through the positioning grooves 202*b* formed thereon, and are finally positioned on the first step 201.

Preferably, fixing protrusions 204*a* which are configured to fix the second assembling block 205 are arranged on two sides of the first assembling block 204; two sides of the second assembling block 205 extend towards the first assembling block 204 to form two fixing arms 205*a*; a spacing between the two fixing arms 205*a* is equal to the size of the first assembling block 204, and each fixing arm 205*a* is provided with a fixing hole 205*b* which is matched with the corresponding fixing protrusion 204*a*; during the mounting process, the second assembling block 205 is pushed towards the first assembling block 204 mounted on the first step 201, such that the first assembling block 204 is clamped between the two fixing arms 205*a*; the first assembling block 204 and the second assembling block 205 are fixedly connected by clamping the fixing protrusions 204*a* into the fixing holes 205*b*.

Preferably, one end of the control terminal 21 is plugged into the pedestal 2 and electrically connected to a coil 12 in a base 1; one end of the power terminal 22 is plugged into the pedestal 2 and matched with a first movable contact 241 on the contact support 24 in the pedestal 2; one end of the auxiliary terminal 23 is plugged into the pedestal 2 and matched with a second movable contact 242 on the contact support 24 in the pedestal 2; the other ends of the control terminal 21, the power terminal 22 and the auxiliary terminal 23 are configured to be connected to external wires.

Preferably, each of the control terminal 21, the power terminal 22 and the auxiliary terminal 23 comprises a conductive sheet and an elastic sheet, wherein one end of the conductive sheet is plugged into the pedestal 2, and the other end of the conductive sheet is vertically arranged to be matched with the elastic sheet and configured to be connected to an external wire; the plug-in end of the conductive sheet of the control terminal 21 is arranged vertically; the plug-in end of the conductive sheet of the power terminal 22 is arranged horizontally and is provided with a first static contact 220 matched with the first movable contact 241; the plug-in end of the conductive sheet of the auxiliary terminal 23 is arranged horizontally and provided with a second static contact 230 matched with the second movable contact 242; one end of the elastic sheet is provided with a fixed end which is fixedly connected to the conductive sheet, and the other end of the elastic sheet is provided with a movable end; the movable end of the elastic sheet is provided with a through hole; the movable end sleeves the end part, which is matched with the elastic sheet, of the conductive sheet through the through hole formed thereon; two sidewalls at the end part of the conductive sheet form a wiring gap and a movable gap with two sidewalls of the through holes respectively; an external wire is clamped in the wiring gap between the movable end and the conductive sheet.

Preferably, the contactor further comprises a base 1, wherein screw holes 14 are formed in four corners of a bottom plate of the base 1 and configured to mount the contactor in a use position; a magnetic yoke 11 and a coil 12 are mounted in the base 1; the pedestal 2 is stacked on the base 1; the sidewall of the base 1 is provided with a buckle 13 configured to fix the pedestal 2; the sidewall of the first step 201 of the pedestal 2 is provided with a clamping hole 201*c* which is matched with the buckle 13; the contact support 24 is mounted in the pedestal 2; the first movable contact 241 which can control a circuit related to the power terminal 22 to be switched on and the second movable contact 242 which can control a circuit related to the auxiliary terminal 23 to be switched on are mounted on the contact support 24; the second movable contact 241 is located above the first movable contact 242.

According to the contactor of the present invention, by mounting the power terminals, the control terminals and the auxiliary terminals on the stepped pedestal in a layered manner, the power terminals and the control terminals are located on the same step and the auxiliary terminals are located on the upper step. Therefore, the structure is simple, and thus the wiring areas can be distinguished apparently. After the power terminals are wired, the wiring of the control terminals and the auxiliary terminals is not affected, which is convenient for identification and wiring. In the case that the product width does not increase, the number of auxiliary contacts that are attached to the product body is increased. A user does not need to purchase additional mounting accessories to expand the auxiliary contacts, thereby improving the cost performance of the product. Meanwhile, the auxiliary contacts of the product body are used instead of the mounting accessories to expand the auxiliary contacts, so as to avoid the risk that the accessories cannot be matched reliably with the contact body, thereby improving the on-off reliability of the auxiliary contacts.

DETAILED DESCRIPTIONS OF THE PREFERRED EMBODIMENTS

The specific embodiments of the contactor of the present invention will be further described below with reference to the embodiments given in FIGS. 1 to 9. The contactor of the present invention is not limited to the description of the following embodiments.

Figure 1:
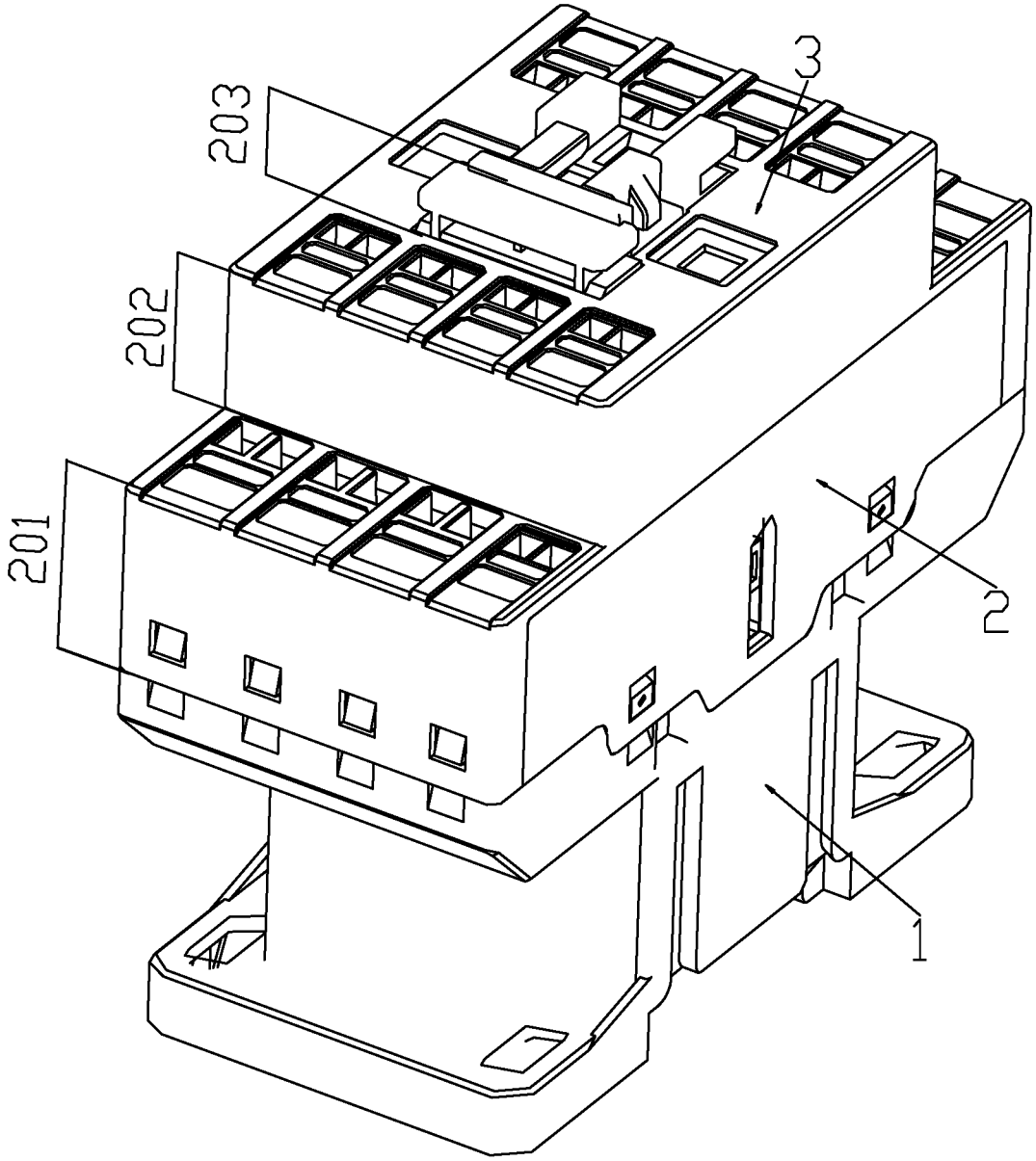
FIG. 1 is a schematic structural diagram of a contactor according to the present invention.
Figure 2:
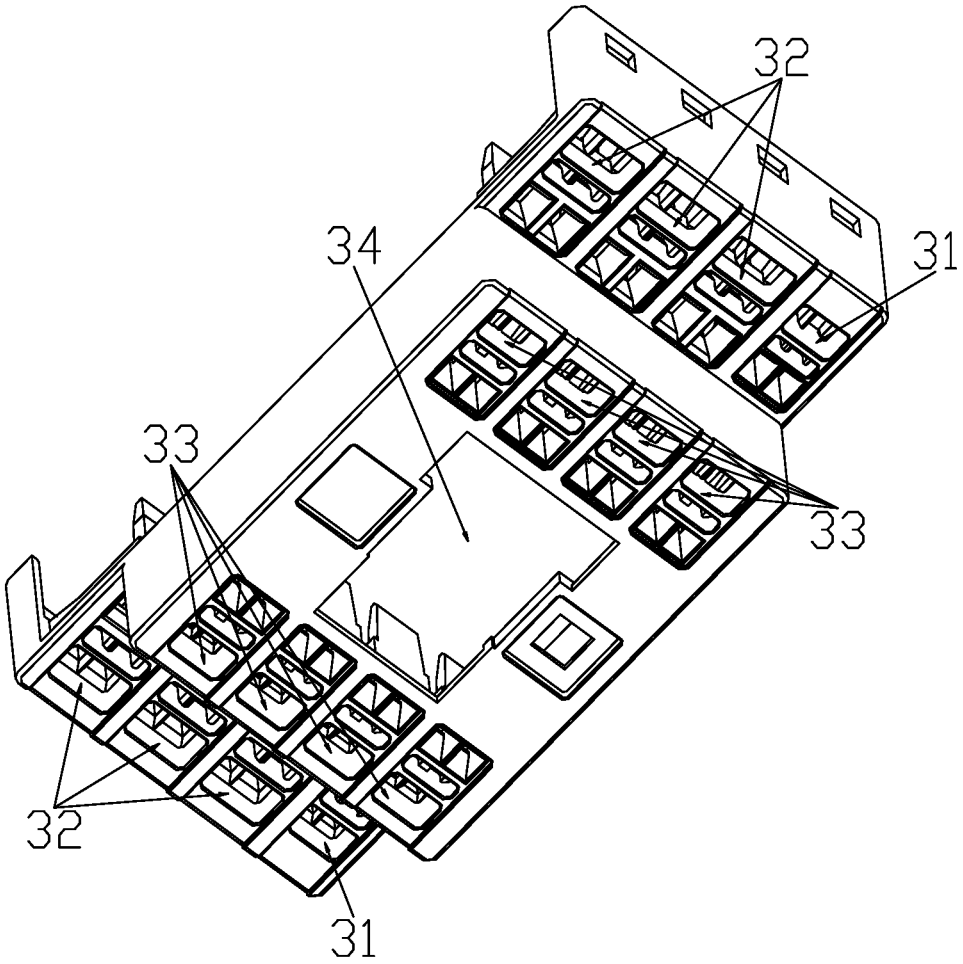
FIG. 2 is a schematic structural diagram of a cover body according to the present invention.

As shown in FIGS. 1 and 2, a contactor of the present invention comprises a pedestal 2, wherein the pedestal 2 is of a step structure having notches in two ends. The step structure comprises a first step 201 and a second step 202 from bottom to top and is covered with a cover body 3 having a matched shape. A part, which protrudes out of the second step 202, at each of two ends of the first step 201 is provided with a first mounting groove in which a control terminal 21 and a power terminal 22 that are spaced apart from each other are mounted, and the cover body 3 is provided with a first wiring port 31 corresponding to the control terminal 21 and a second wiring port 32 corresponding to the power terminal 22. Each of two ends of the second step 202 is provided with a second mounting groove in which an auxiliary terminal 23 is mounted, and the cover body 3 is provided with a third wiring port 33 which corresponds to the auxiliary terminal 23 mounted in the second mounting groove. The pedestal and the cover body may be of an integrated structure or a detachable split structure. According to the contactor of the present invention, by mounting the power terminals, the control terminals and the auxiliary terminals on the stepped pedestal in a layered manner, the power terminals and the control terminals are located on the same step and the auxiliary terminals are located on the upper step. Therefore, the structure is simple, and thus the wiring areas can be distinguished apparently. After the power terminals are wired, the wiring of the control terminals and the auxiliary terminals is not affected, which is convenient for identification and wiring. In the case that the product width does not increase, the number of auxiliary contacts that are attached to the product body is increased. A user does not need to purchase additional mounting accessories to expand the auxiliary contacts, thereby improving the cost performance of the product. Meanwhile, the auxiliary contacts of the product body are used instead of the mounting accessories to expand the auxiliary contacts, so as to avoid the risk that the accessories cannot be matched reliably with the contact body, thereby improving the on-off reliability of the auxiliary contacts. Of course, it is also possible to arrange the power terminals, the control terminals and the auxiliary terminals on the three steps of the pedestal respectively, such that the control terminals are located above the power terminals, and the auxiliary terminals are located above the control terminals. In view of this, the structure of the present embodiment is simpler, more compact and reasonable.

Specifically, a control terminal 21 and three power terminals 22 which are spaced apart from each other are sequentially mounted in each of the first mounting grooves. A first insulation baffle 201*b* which has a partitioning function is arranged between the control terminal 21 and the power terminal 22 as well as between the power terminals 22 in the first mounting groove, respectively. Four auxiliary terminals 23 which are spaced apart from each other are mounted in each of the second mounting grooves. A second insulation baffle 202*c* which has a partitioning function is arranged between every two auxiliary terminals 23 in the second mounting groove. Each mounting groove is divided into a plurality of independent small grooves by means of the insulation baffles, such that each terminal is independently mounted in the corresponding small groove, without interfering with each other. Moreover, the first wiring port 31 and the second wiring port 32 are formed in the cover body 3 in a direction perpendicular to the top surface of the first step 201. The third wiring port 33 is formed in the cover body 3 in a direction perpendicular to the top surface of the second step 202. When the contactor is mounted, a base of the contactor is fixed at the use position by screws or guide rails. The bottom surface of the base is vertically attached to the use position, such that the top surface of the pedestal faces the user. The opening direction of each wiring port is perpendicular to the top surface of the pedestal, so that the wiring port also faces the user, which is convenient for identification and wiring. In addition, the control terminal 21 and the power terminal 22 are not aligned, such that the control terminals 21 located at two ends of the first step 201 are closer to or away from the middle part of the first step 201 relative to the respective power terminals 22 located on the same end; the first wiring port 31 corresponding to the control terminal 21 is also not aligned to the second wiring port 32 corresponding to the power terminal 22. Since the two kinds of terminals located at the same level are not aligned, the two kinds of terminals are visually and intuitively distinguished, thereby preventing the user from confusing and misconnecting the wires, and improving the wiring convenience and accuracy. It is also possible to provide an identifier on the cover body to distinguish the first and second wiring ports.

Figure 3:
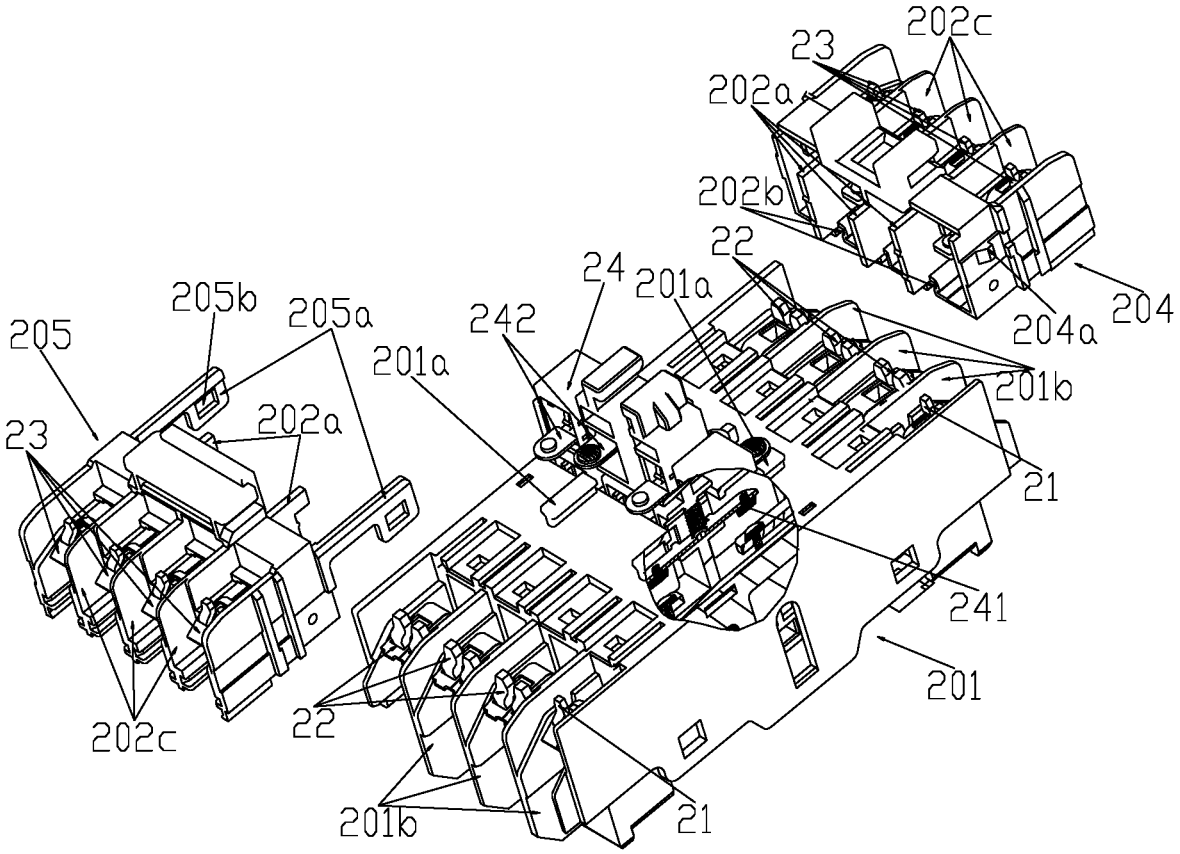
FIG. 3 is an exploded view of a pedestal according to the present invention.
Figure 4:
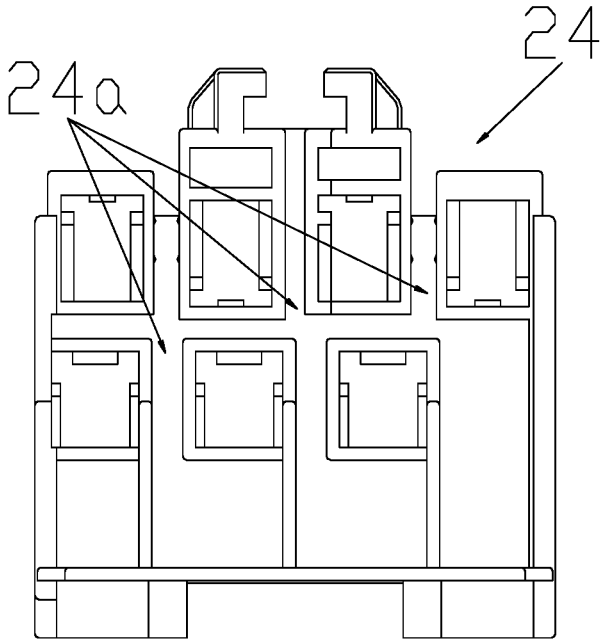
FIG. 4 is a side view of a contact support according to the present invention.

As shown in FIG. 3 and FIG. 4, according to the assembling structure of the pedestal of the present invention, an assembling groove is formed in the middle of the integrated first step 201. A contact support 24 is mounted in the assembling groove. The contact support 24 protrudes out of the top surface of the first step 201. The second step 202 is of an assembled structure and comprises a first assembling block 204 and a second assembling block 205 which can be assembled, wherein the first assembling block 204 and the second assembling block 205 are mounted on the first step 201 and are located on two sides of the contact support 24 and clamped with the contact support 24 respectively. A surface, which is in contact with the contact support 24, of each of the first assembling block 204 and the second assembling block 205 is provided with a vertical limiting rib 202*a* which is configured to limit and guide the action of the contact support 24. A limiting groove 24*a* which is matched with the limiting rib 202*a* is formed in two sides of the contact support 24 respectively. The limiting ribs and the limiting grooves are configured to play limiting and guiding roles, such that the contact support clamped between the two assembling blocks can only move upwards and downwards along the limiting ribs, thereby improving the reliability and accuracy of the action of the contact support. Further, the middle part of the first step 201 extends towards the first assembling block 204 and the second assembling block 205 respectively to form positioning ribs 201*a* located on two sides of the contact support 24. Each of the first assembling block 204 and the second assembling block 205 is provided with a positioning groove 202*b* which is matched with the corresponding positioning rib 201*a*. During the mounting process, the first assembling block 204 and the second assembling block 205 are pushed towards the contact support 24 along the positioning ribs 201*a* respectively through the positioning grooves 202*b* formed thereon, and are finally positioned on the first step 201. The positioning and fixing structure is simple and reliable, and facilitates positioning the first and second assembling blocks on the first step and guiding the assembling there between, thereby improving the assembly efficiency and convenience. In addition, fixing protrusions 204*a* which are configured to fix the second assembling block 205 are arranged on two sides of the first assembling block 204. Two sides of the second assembling block 205 extend towards the first assembling block 204 to form two fixing arms 205*a*. A spacing between the two fixing arms 205*a* is equal to the size of the first assembling block 204, and each fixing arm 205*a* is provided with a fixing hole 205*b* which is matched with the corresponding fixing protrusion 204*a*. During the mounting process, the second assembling block 205 is pushed towards the first assembling block 204 mounted on the first step 201, such that the first assembling block 204 is clamped between the two fixing arms 205*a*. The first assembling block 204 and the second assembling block 205 are fixedly connected by clamping the fixing protrusions 204*a* into the fixing holes 205*b*. The assembled fixing structure is simple and firm, thereby improving the assembly efficiency and reliability. In addition, the contact support 24 passes through a through hole 34 in the cover body 3 to form a penetrating part, and the first assembling block 204 and the second assembling block 205 extend upwards respectively to form extension parts that are located on two sides of the penetrating part of the contact support 24. The penetrating part of the contact support 24 and the extension parts of the first assembling block 204 and the second assembling block 205 form a third step 203 on which an auxiliary device, such as an auxiliary module, a timer module or a communication module, of the contactor is mounted.

Figure 5:
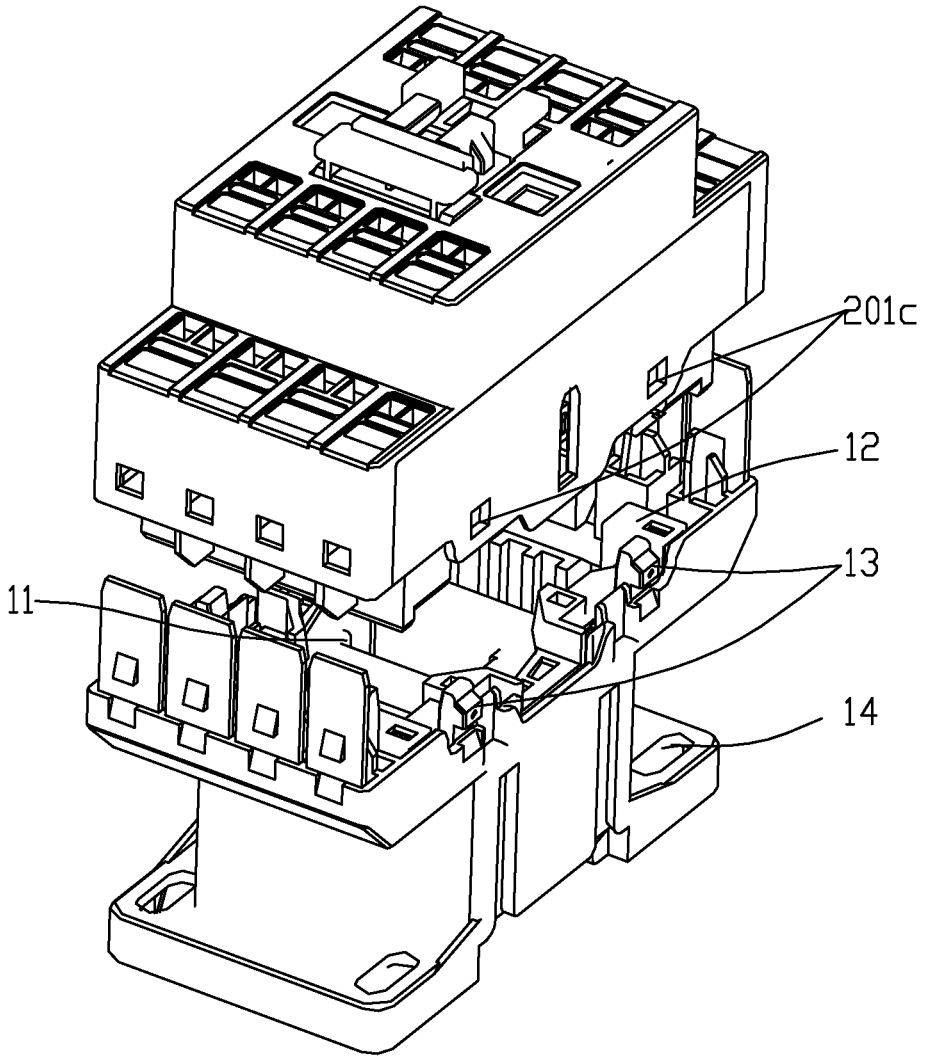
FIG. 5 is an exploded view of the contactor according to the present invention.

As shown in FIG. 5, the contactor of the present invention further comprises a base 1. Screw holes 14 are formed in four corners of a bottom plate of the base 1 and configured to mount the contactor to a use position. A magnetic yoke 11 and a coil 12 are mounted in the base 1. The pedestal 2 is stacked on the base 1. The sidewall of the base 1 is provided with a buckle 13 configured to fix the pedestal 2. The sidewall of the first step 201 of the pedestal 2 is provided with a clamping hole 201*c* which is matched with the buckle 13. The contact support 24 is mounted in the pedestal 2. The first movable contact 241 which can control a circuit related to the power terminal 22 to be switched on and the second movable contact 242 which can control a circuit related to the auxiliary terminal 23 to be switched on are mounted on the contact support 24. The second movable contact 241 is located above the first movable contact 242.

According to the structure of the control terminals, the power terminals and the auxiliary terminals of the present invention, one end of each control terminal 21 is plugged into the pedestal 2 and electrically connected to a coil 12 in the base 1. One end of each power terminal 22 is plugged into the pedestal 2 and matched with a first movable contact 241 on the contact support 24 in the pedestal 2, such that a circuit related to the power terminal 22 can be controlled to be switched on; one end of each auxiliary terminal 23 is plugged into the pedestal 2 and matched with a second movable contact 242 on the contact support 24 in the pedestal 2, such that a circuit related to the auxiliary terminal 23 can be controlled to be switched on. The other ends of the control terminal 21, the power terminal 22 and the auxiliary terminal 23 are configured to be connected to external wires.

Figure 6:
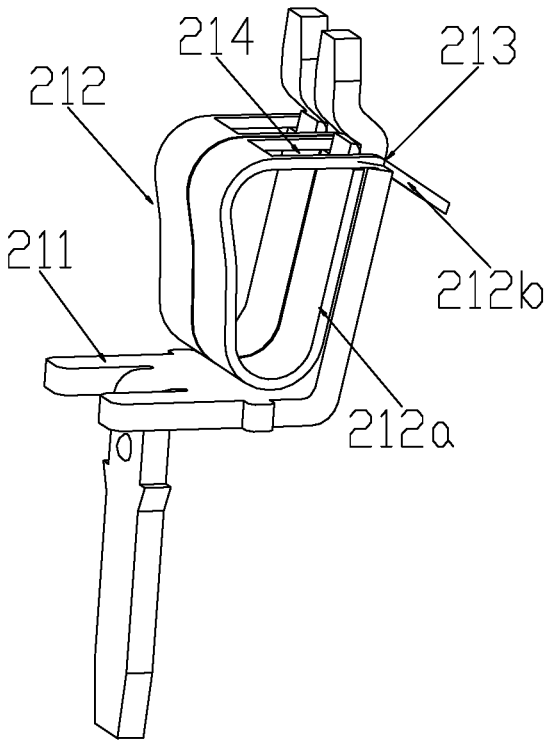
FIG. 6 is a schematic structural diagram of a control terminal according to the present invention.

As shown in FIG. 6, each control terminal 21 comprises a first conductive sheet 211 and a first elastic sheet 212, wherein one end of the first conductive sheet 211 is plugged into the pedestal 2, and the other end of the first conductive sheet 211 is vertically arranged to be matched with the first elastic sheet 212 and configured to be connected to an external wire. The plug-in end of the first conductive sheet 211 of the control terminal 21 is arranged vertically. One end of the first elastic sheet 212 is provided with a first fixed end 212*a* which is fixedly connected to the first conductive sheet 211, and the other end of the first elastic sheet 212 is provided with a first movable end 212*b*. The first movable end 212*b* of the first elastic sheet 212 is provided with a through hole. The first movable end 212*b* sleeves the end part, which is matched with the first elastic sheet 212, of the first conductive sheet 211 through the through hole formed thereon. Two sidewalls at the end part of the first conductive sheet 211 form a first wiring gap 213 and a first movable gap 214 with two sidewalls of the through hole. An external wire is clamped in the first wiring gap 213 between the first movable end 212*b* and the first conductive sheet 211. The control terminal has a flexible wiring structure and a plug-in mounting structure, and the wiring and assembly are simple and convenient, thereby improving the efficiency and convenience.

Figure 7:
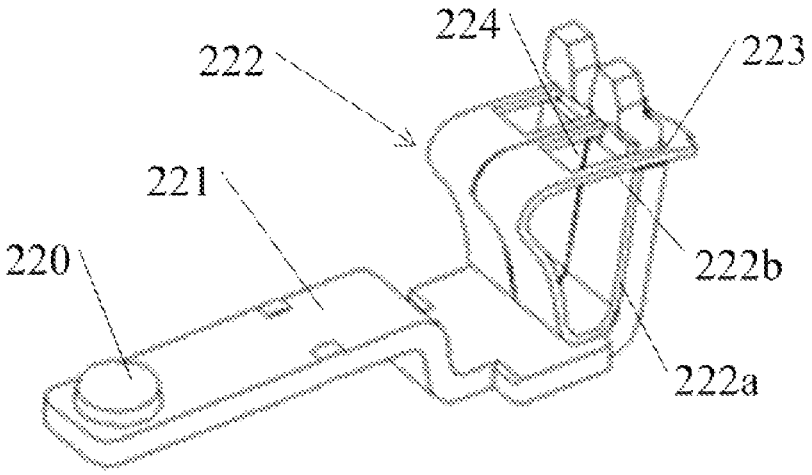
FIG. 7 is a schematic structural diagram of a power terminal according to the present invention.

As shown in FIG. 7, each power terminal 22 of the present invention comprises a second conductive sheet 221 and a second elastic sheet 222, wherein one end of the second conductive sheet 221 is plugged into the pedestal 2, and the other end of the second conductive sheet 221 is vertically arranged to be matched with the second elastic sheet 222 and configured to be connected to an external wire. The plug-in end of the second conductive sheet 221 of the power terminal 22 is arranged horizontally and provided with a first static contact 220 matched with the first movable contact 241. One end of the second elastic sheet 222 is provided with a second fixed end 222*a* which is fixedly connected to the second conductive sheet 221, and the other end of the second elastic sheet 222 is provided with a second movable end 222*b*. The second movable end 222*b* of the second elastic sheet 222 is provided with a through hole. The second movable end 222*b* sleeves the end part, which is matched with the second elastic sheet 222, of the second conductive sheet 221 through the through hole formed thereon. Two sidewalls at the end part of the second conductive sheet 221 form a second wiring gap 223 and a second movable gap 224 with two sidewalls of the through hole. An external wire is clamped in the second wiring gap 223 between the second movable end 222*b* and the second conductive sheet 221. The power terminal has a flexible wiring structure and a plug-in mounting structure, and the wiring and assembly are simple and convenient, thereby improving efficiency and convenience. The plug-in end of the second conductive sheet 221 is of a stepped plate structure, and a part, where the first static contact 220 is arranged, of the plug-in end of the second conductive sheet 221 on the top surface is higher than a part connected to a wiring terminal. By means of the stepped structure, the power terminal can be mounted more firmly.

Figure 8:
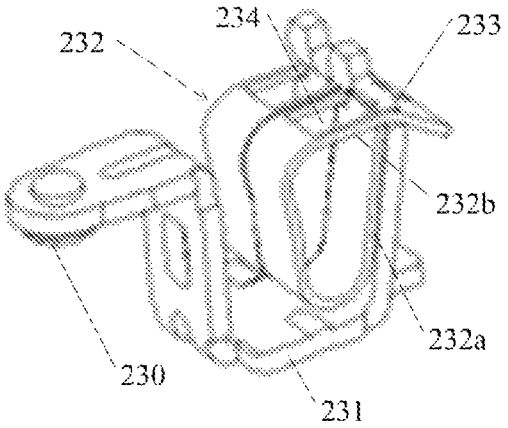
FIG. 8 is a schematic structural diagram of an embodiment of an auxiliary terminal according to the present invention.
Figure 9:
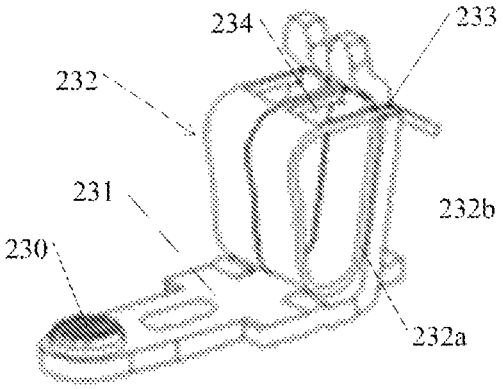
FIG. 9 is a schematic structural diagram of another embodiment of the auxiliary terminal according to the present invention.

As shown in FIGS. 8 and 9, each auxiliary terminal 23 of the present invention comprises a third conductive sheet 231 and a third elastic sheet 232, wherein one end of the third conductive sheet 231 is plugged into the pedestal 2, and the other end of the third conductive sheet 231 is vertically arranged to be matched with the third elastic sheet 232 and configured to be connected to an external wire. The plug-in end of the third conductive sheet 231 of the auxiliary terminal 23 is arranged horizontally and provided with a second static contact 230 matched with the second movable contact 242. One end of the third elastic sheet 232 is provided with a third fixed end 232*a* which is fixedly connected to the third conductive sheet 231, and the other end of the third elastic sheet 232 is provided with a third movable end 232*b*. The third movable end 232*b* of the third elastic sheet 232 is provided with a through hole. The third movable end 232*b* sleeves the end part, which is matched with the third elastic sheet 232, of the third conductive sheet 231 through the through hole formed thereon. Two sidewalls at the end part of the third conductive sheet 231 form a third wiring gap 233 and a third movable gap 234 with two sidewalls of the through hole. An external wire is clamped in the third wiring gap 233 between the third movable end 232*b* and the third conductive sheet 231. The auxiliary terminal has a flexible wiring structure and a plug-in mounting structure, and the wiring and assembly are simple and convenient, thereby improving efficiency and convenience. FIG. 8 illustrates an embodiment of the auxiliary terminal, wherein the plug-in end of the third conductive sheet 231 of the auxiliary terminal 23 is of a stepped plate structure, and a part, where the second static contact 230 is arranged, of the plug-in end of the third conductive sheet 231 is higher than a part connected to a wiring terminal. By means of the stepped structure, the power terminal can be mounted more firmly. FIG. 9 illustrates another embodiment of the present invention, the plug-in end of the third conductive sheet 231 of the auxiliary terminal 23 is of a flat plate structure, and the top surface of the flat plate structure is provided with a second static contact 230. By means of the flat plate structure, the mounting structure of the auxiliary terminal is simple.

The above content is a further detailed description of the present invention in connection with the specific preferred embodiments, and the specific embodiments of the present invention are not limited to these descriptions. It is apparent for those ordinary skilled in the art that several simple deductions or substitutions which are made without departing from the concept of the present invention should be considered to fall within the protection scope of the present invention.

The invention claimed is:

1. A contactor, comprising a pedestal, both end of the pedestal are step structure having notches in two ends;

the step structure comprises a first step and a second step from bottom to top and is covered with a cover body having a matched shape;

a part, which protrudes out of the second step, at each of two ends of the first step is provided with a first mounting groove in which a control terminal and a power terminal that are spaced apart from each other are mounted, and the cover body is provided with a first wiring port corresponding to the control terminal and a second wiring port corresponding to the power terminal; and each of two ends of the second step is provided with a second mounting groove in which an auxiliary terminal is mounted, and the cover body is provided with a third wiring port which corresponds to the auxiliary terminal mounted in the second mounting groove;

wherein an assembling groove is formed in the middle of the first step; a contact support is mounted in the assembling groove; the contact support protrudes out of the top surface of the first step; the second step is of an assembled structure and comprises a first assembling block and a second assembling block which can be assembled, wherein the first assembling block and the second assembling block are mounted on the first step and are located on two sides of the contact support respectively.

2. The contactor according to claim 1, wherein:

the first wiring port and the second wiring port are formed in the cover body in a direction perpendicular to the top surface of the first step; and the third wiring port is formed in the cover body in a direction perpendicular to the top surface of the second step.

3. The contactor according to claim 1, wherein:

the control terminal and the power terminal are not aligned, such that the control terminals located at two ends of the first step are closer to or away from the middle part of the first step relative to the respective power terminals located on the same end; and the first wiring port corresponding to the control terminal is also not aligned to the second wiring port corresponding to the power terminal.

4. The contactor according to claim 1, wherein:

a surface, which is in contact with the contact support, of each of the first assembling block and the second assembling block is provided with a vertical limiting rib; and a limiting groove which is matched with the limiting rib is formed in two sides of the contact support respectively.

5. The contactor according to claim 1, wherein:

the middle part of the first step extends towards the first assembling block and the second assembling block respectively to form positioning ribs located on two sides of the contact support;

each of the first assembling block and the second assembling block is provided with a positioning groove which is matched with the corresponding positioning rib; and during the mounting process, the first assembling block and the second assembling block are pushed towards the contact support along the positioning ribs respectively through the positioning grooves formed thereon, and are finally positioned on the first step.

6. The contactor according to claim 1, wherein:

fixing protrusions which are configured to fix the second assembling block are arranged on two sides of the first assembling block;

two sides of the second assembling block extend towards the first assembling block to form two fixing arms;

a spacing between the two fixing arms is equal to the size of the first assembling block, and each fixing arm is provided with a fixing hole which is matched with the corresponding fixing protrusion;

during the mounting process, the second assembling block is pushed towards the first assembling block mounted on the first step, such that the first assembling block is clamped between the two fixing arms; and the first assembling block and the second assembling block are fixedly connected by clamping the fixing protrusions into the fixing holes.

7. The contactor according to claim 1, wherein:

one end of the control terminal is plugged into the pedestal and electrically connected to a coil in a base;

one end of the power terminal is plugged into the pedestal and matched with a first movable contact on the contact support in the pedestal;

one end of the auxiliary terminal is plugged into the pedestal and matched with a second movable contact on the contact support in the pedestal; and the other ends of the control terminal, the power terminal and the auxiliary terminal are configured to be connected to external wires.

8. The contactor according to claim 7, wherein:

each of the control terminal, the power terminal and the auxiliary terminal comprises a conductive sheet and an elastic sheet, wherein one end of the conductive sheet is plugged into the pedestal, and the other end of the conductive sheet is vertically arranged to be matched with the elastic sheet and configured to be connected to an external wire;

the plug-in end of the conductive sheet of the control terminal is arranged vertically;

the plug-in end of the conductive sheet of the power terminal is arranged horizontally and is provided with a first static contact matched with the first movable contact;

the plug-in end of the conductive sheet of the auxiliary terminal is arranged horizontally and provided with a second static contact matched with the second movable contact;

one end of the elastic sheet is provided with a fixed end which is fixedly connected to the conductive sheet, and the other end of the elastic sheet is provided with a movable end;

the movable end of the elastic sheet is provided with a through hole;

the movable end sleeves the end part, which is matched with the elastic sheet, of the conductive sheet through the through hole formed thereon;

two sidewalls at the end part of the conductive sheet form a wiring gap and a movable gap with two sidewalls of the through hole; and an external wire is clamped in the wiring gap between the movable end and the conductive sheet.

9. The contactor according to claim 1, further comprising:

a base in which a magnetic yoke and a coil are mounted;

the pedestal is stacked on the base; the sidewall of the base is provided with a buckle configured to fix the pedestal;

the sidewall of the first step of the pedestal is provided with a clamping hole which is matched with the buckle;

the contact support is mounted in the pedestal;

the first movable contact which can control a circuit related to the power terminal to be switched on and the second movable contact which can control a circuit related to the auxiliary terminal to be switched on are mounted on the contact support; and the second movable contact is located above the first movable contact.

* * * * *